US009010460B2

(12) United States Patent
Meeten et al.

(10) Patent No.: US 9,010,460 B2
(45) Date of Patent: Apr. 21, 2015

(54) SYSTEM AND METHOD FOR DRILLING USING DRILLING FLUIDS

(75) Inventors: Gerald H. Meeten, Herts (GB); Richard H. Mills, Cambridge (GB)

(73) Assignee: Schlumberger Technology Corporation, Cambridge, MA (US)

( * ) Notice: Subject to any disclaimer, the term of this patent is extended or adjusted under 35 U.S.C. 154(b) by 530 days.

(21) Appl. No.: 12/496,859

(22) Filed: Jul. 2, 2009

(65) Prior Publication Data

US 2011/0000713 A1 Jan. 6, 2011

(51) Int. Cl.
*E21B 21/08* (2006.01)
*E21B 47/10* (2012.01)

(52) U.S. Cl.
CPC ..... *E21B 47/102* (2013.01)

(58) Field of Classification Search
CPC ..... E21B 49/005; E21B 21/08
USPC ..... 175/38; 73/152.04, 152.19, 152.42, 73/152.55; 324/324, 325
See application file for complete search history.

(56) References Cited

U.S. PATENT DOCUMENTS

| | | | | | |
|---|---|---|---|---|---|
| 1,555,802 | A | * | 9/1925 | Huber | 324/325 |
| 2,655,631 | A | * | 10/1953 | Walstrom | 324/325 |
| 2,826,736 | A | * | 3/1958 | Henri-Georges | 324/325 |
| 2,859,404 | A | | 11/1958 | Crittendon | |
| 2,922,103 | A | * | 1/1960 | Smith | 324/324 |
| 3,308,894 | A | | 3/1967 | Reinhart | |
| 3,776,032 | A | * | 12/1973 | Vogel | 73/152.19 |
| 4,980,642 | A | * | 12/1990 | Rodney | 324/325 |
| 5,005,406 | A | | 4/1991 | Jasinski et al. | |
| 5,287,752 | A | * | 2/1994 | Den Boer | 73/861.04 |
| 5,574,371 | A | * | 11/1996 | Tabanou et al. | 324/324 |
| 5,661,237 | A | * | 8/1997 | Dussan et al. | 73/152.18 |
| 5,736,637 | A | * | 4/1998 | Evans et al. | 73/152.31 |
| 5,793,640 | A | | 8/1998 | Wu et al. | |
| 6,017,854 | A | * | 1/2000 | Van Slyke | 507/118 |
| 6,272,915 | B1 | * | 8/2001 | Kostelnicek et al. | 73/152.28 |
| 7,129,704 | B2 | * | 10/2006 | Delhomme et al. | 324/325 |
| 2003/0020493 | A1 | | 1/2003 | Haase et al. | |
| 2003/0206024 | A1 | | 11/2003 | Murphy, Jr. et al. | |
| 2009/0157361 | A1 | * | 6/2009 | Toghi et al. | 703/3 |

OTHER PUBLICATIONS

American Petroleum Institute: "Electrical stability test" Recommended practice standard procedure for field testing oil-based drilling fluids, 2nd edition, Dec. 1, 1991, RP 13B-2, Washington, DC, section 6, pp. 21-22.

Chilingarian et al: "Basic concepts of drilling and drilling-fluid technology", Drilling and drilling fluids Updated textbook edition, Developments in Petroleum Science 11, Elsevier, Amsterdam, 1983, chapter 2, pp. 17-88.

Dukhin et al: "Polarization of a thin double layer and the dispersion of the dielectric constant of suspensions of nonconducting spherical particles", Dielectric phenomena and the double layer in disperse systems and polyelectrolytes John Wiley & Sons, New York, 1974, chapter 3, pp. 54-83.

(Continued)

*Primary Examiner* — Shane Bomar
*Assistant Examiner* — Kipp Wallace

(57) ABSTRACT

A method and a system for detecting or measuring influxes of formation water or brine into a drilling fluid being used to drill a borehole through an earth formation are described. The method and system comprising using an electrode based sensor system to determine changes in capacitance and/or conductance of the drilling fluid.

22 Claims, 11 Drawing Sheets

(56) References Cited

OTHER PUBLICATIONS

Gray et al: "The development of drilling fluids technology", Composition and properties of oil well drilling fluids, 4th edition, Gulf, Houston, 1981, chapter 2, pp. 37-89.

International Search Report of PCT Application No. PCT/IB2010/001609 dated Apr. 27, 2011: pp. 1-10.

* cited by examiner

SYSTEM AND METHOD FOR DRILLING USING DRILLING FLUIDS

BACKGROUND OF THE DISCLOSURE

This disclosure relates in general to drilling a borehole using a drilling fluid and, more specifically, but not by way of limitation, to detecting, measuring and/or controlling influxes of formation water and/or brine into the borehole.

To access a subsurface hydrocarbon reservoir, it is common practice to drill a hole, generally referred to as a borehole or wellbore, through intervening rock formations using a rotating drill bit at the lower end of a hollow drill pipe. The diameter of the borehole is determined by the diameter of the drill bit, which exceeds the outer diameter of the drill pipe, and, as a result, produces an annulus between the drill pipe and the interior surface of the borehole. In the drilling procedure, rock cuttings produced by the drill bit cutting its way through the earth formation are carried away from the drill bit up to the surface via the annulus by a drilling fluid, which may be a drilling mud or the like, where it is usual to pump the drilling fluid down the hollow drill pipe and back up the annulus when the cuttings are removed and various properties of the fluid may be measured prior to subsequent circulation through the borehole.

Two main types of drilling fluid are commonly used in drilling procedures. In the first type of drilling fluid the external liquid phase is aqueous, i.e., the drilling fluid may comprise a water-based-mud ("WBM") or the like, and in the second type of drilling fluid the external liquid phase is oleaginous, i.e., the drilling fluid may comprise an oil-based-mud ("OBM") or the like. For purposes of this specification WBMs and OBMs are provided as examples of drilling fluids, however, the term drilling fluid(s) may encompass other types of materials, fluids and/or the like.

The oleaginous external, or continuous, phase of OBM is typically kerosene or a similar light liquid hydrocarbon in which is dissolved various oil-soluble surfactants. The internal, or dispersed, phase of OBM typically comprises: (a) an oleophilic clay to impart the desired rheology to the mud; (b) a dense mineral, such as barite, to impart the desired density to the mud; and (c) an emulsified-aqueous brine to impart the desired water activity to the mud. In use, the OBM accumulates formation fines or solids, where the fines and/or solids are circulated through the annulus with the OBM, pass through a shale-shaker and re-enter the circulated OBM. Oil-soluble surfactants may be used with the OBM to prevent agglomeration of mineral particles, such as barite and formation fines, and to emulsify the emulsified-aqueous brine to provide a stable water-in-oil emulsion. By altering the salt concentration in the brine, the water activity of the mud can be changed so that it approximates that of the formation being drilled, which serves to prevent instability of the borehole being drilled due to the welling or shrinking of shale and compacted clay formations surrounding the borehole.

In OBM supplied to a drilling rig, the oil-soluble surfactants in the OBM are in excess of the amounts required for effective use of the OBM in a drilling procedure. The excess amount of the oil-soluble surfactants may be provided so that extra solids and aqueous liquids that may be acquired by the mud while drilling can be effectively dispersed in the mud. The acquisition rate of solids and aqueous liquids by the mud is usually determined by the penetration rate of the bit. However, a problem may occur when a water or brine influx into the borehole occurs from freshwater or brine aquifers encountered during the drilling process. Such influxes can add aqueous liquid rapidly to the OBM.

Owing to the excess emulsifier present in the OBM, influxes of freshwater or brine become emulsified and add to the existing aqueous phase already present in the OBM and have undesirable effects on several of the mud's parameters, e.g. rheology, density, fluid loss, and water activity. Of particular relevance is the effect of the influx on the American Petroleum Institute ("API")/Emulsion Stability Test ("EST"), which is routinely used during the drilling process to monitor the mud. The influx of fresh or saline water acts to decrease the EST breakdown voltage ("VBD"), which results in a misleading measure of the emulsion stability. Moreover, the API EST comprises application of high voltages (typically 500V to 1500V) to a probe placed in the drilling fluid to cause an electrical breakdown, which may be hazardous in the presence of gaseous hydrocarbons.

The probe for the API EST consists of two planar electrodes, ⅛ inch in diameter, facing each other 1/16 inch apart, which arrangement requires manual cleaning of mud from the probe between tests and, hence, is not designed nor easily modified for continuous or automatic operation on a drilling rig and/or in a remote drilling environment. These problems with the API EST as well as the danger of the high voltage necessary for the probes use may be overcome by using an embodiment of the present invention, as described below.

BRIEF SUMMARY OF THE DISCLOSURE

Embodiments of the present invention provide for the detection and/or measurement of formation water or brine into a drilling fluid being used in a drilling procedure to drill a borehole through an earth formation.

In one embodiment, the present disclosure provides a method for detecting and monitoring formation water or brine influx into a drilling fluid, the method comprising:

contacting a first and a second electrode with a drilling fluid, the drilling fluid being used in a drilling process to drill a borehole in an earth formation;

applying a potential difference between the first and the second electrode;

measuring at least one of a capacitance and a conductance between the first and the second electrode; and detecting or measuring an influx of water or brine into the drilling fluid from the measured capacitance or conductance.

In another embodiment, the present disclosure provides a system for detecting and monitoring formation water or brine influxes during a drilling procedure, the system comprising:

a drilling-fluid sensor configured for contacting with a drilling fluid being used in a drilling procedure to drill the borehole, the drilling-fluid sensor comprising:

a first electrode;

a second electrode, wherein the first and the second electrode are configured for contacting drilling fluid in the borehole;

a power source for applying a potential difference between the first and the second electrode; and an impedance meter for measuring at least one of a capacitance and a conductance between the first and the second electrode.

In some embodiments of the present invention, a dielectric sensor method for detecting and/or measuring formation water or brine influxes into the drilling fluid is provided where the drilling-fluid sensor, which may in some aspects comprise a dielectric sensor, operates at measurement voltages in the range of less than 500 Volts, or less than a 100 Volts or between 0.1 to 10 Volt and so does not require the generation and use of large electric fields. These smaller electric fields may be used in some embodiments of the present invention, because unlike existing drilling fluid test, such as the API Emulsion Stability Test, high-field breakdown of the drilling fluid is not necessary. However, operation of embodiments of the present invention is not restricted to lower electric field strengths.

BRIEF DESCRIPTION OF THE DRAWINGS

The present disclosure is described in conjunction with the appended figures.

Figure 1:
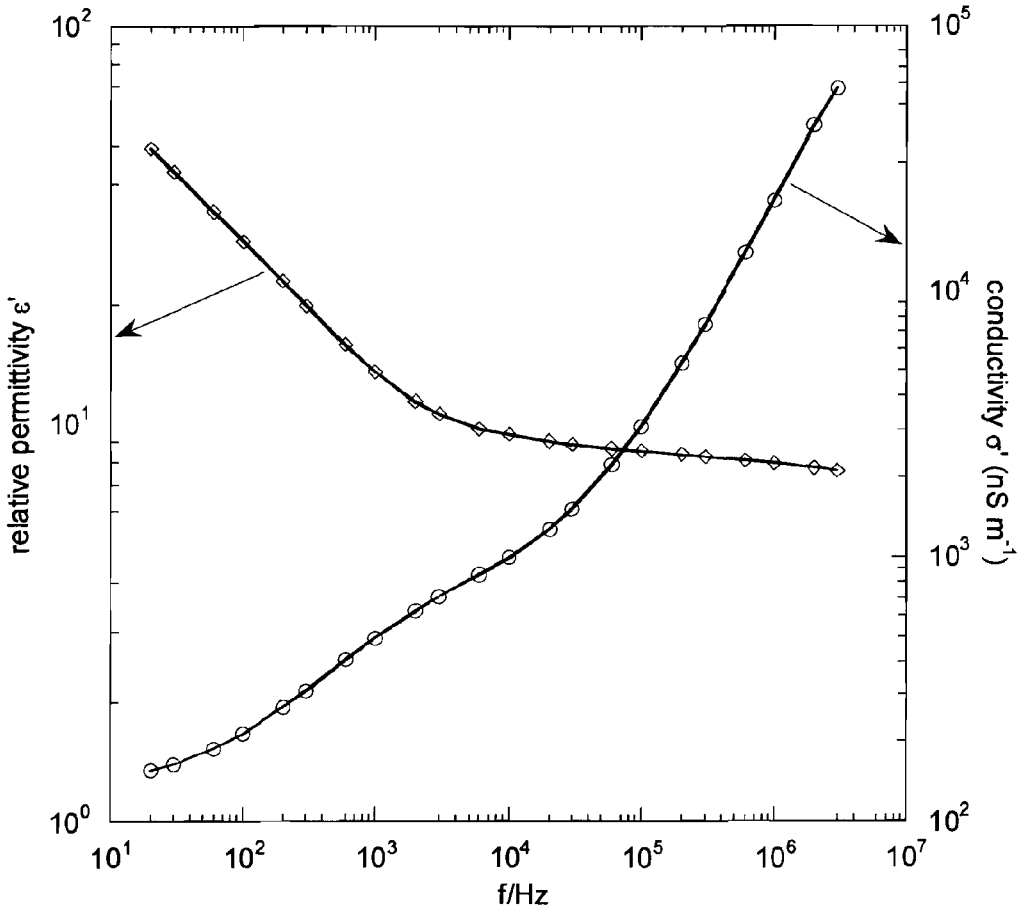
FIG. 1 is a graphical representation of the variation with frequency of the measuring field of dielectric relative permittivity and conductivity for a drilling fluid, in accordance with an aspect of the present invention.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE PREFERRED EMBODIMENT

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention, it being understood that various changes may be made in the function and arrangement of elements without departing from the scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Figure 2:
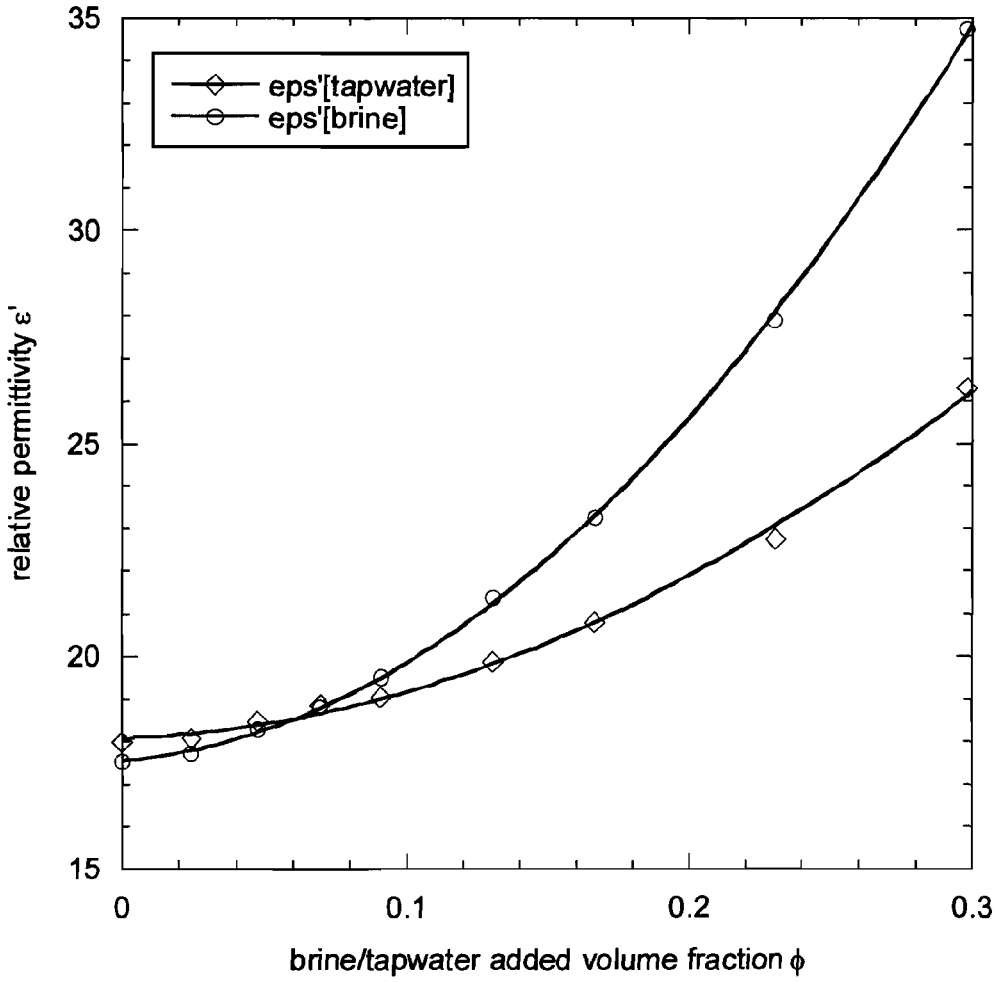
FIG. 2 is a graphical representation illustrating the effect on permittivity of a drilling fluid as a result of adding brine and fresh water to the drilling fluid, the permittivity being measured in accordance with an embodiment of the present invention.
Figure 3:
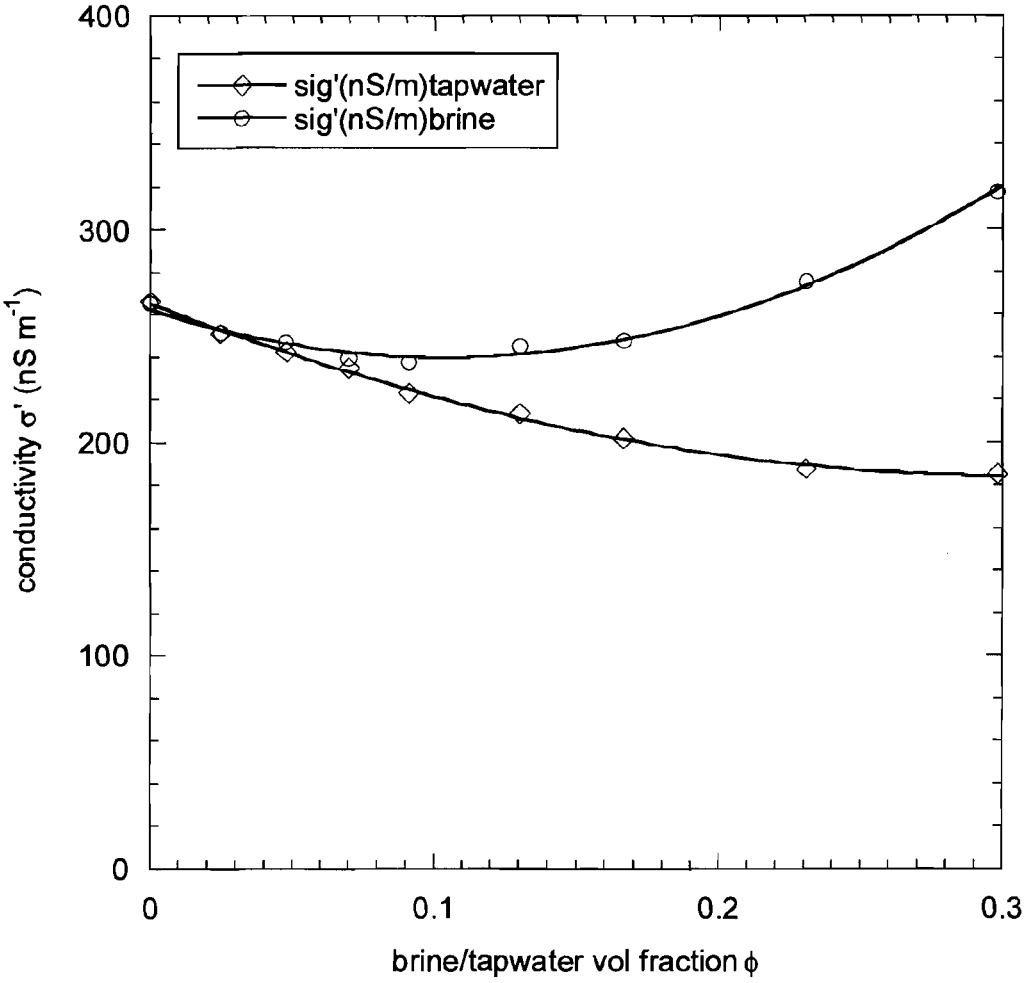
FIG. 3 is a graphical representation illustrating the effect on conductivity of a drilling fluid as a result of adding brine and fresh water to the drilling fluid, the conductivity being measured in accordance with an embodiment of the present invention.

FIG. 2 and FIG. 3 are graphical representations of the variation of dielectric relative permittivity and conductivity for a drilling fluid, in accordance with an aspect of the present invention. In accordance with an embodiment of the present invention, a drilling-fluid sensor, which merely by way of example and without limitation may be referred to as a dielectric sensor and is described in more detail later in this specification, may be used to take measurements on a fluid in which brine or fresh water is added to an OBM. To mimic downhole conditions, the brine or fresh water may be mixed into the OBM with a shear rate and duration typical of a flow of the brine or fresh water into the OBM in an annulus of the borehole being drilled as the brine or freshwater passes from an aquifer adjacent to the borehole to the surface.

In accordance with aspects of the present invention, a drilling-fluid sensor may be used to make measurements of the dielectric relative permittivity $\in'$ and conductivity $\sigma'$ over a wide range of frequencies f. Merely by way of example, these measurements may be made using a measurement voltage of about 10 Volts or the like. In the drilling-fluid sensor of an embodiment of the present invention, the measurement voltage may be applied to drilling fluid disposed between at least two electrodes comprising the drilling-fluid sensor. Merely by way of example, in one aspect of the present invention the electrodes may be positioned so as to be parallel to one another. In other aspects, other arrangement of the electrodes may be used. Merely by way of example, in one aspect of the present invention, the electrodes may have a curved shape, i.e., cylindrical or the like and may be disposed coaxially with one another. Merely by way of example, in one aspect of the present invention the electrodes may comprise stainless steel. In other aspects, the electrodes may comprise any other conductive materials.

As illustrated in FIG. 1, the measured permittivity $\in'$ and conductivity $\sigma'$ are physical properties of the drilling fluid that are not influenced by the details of the measurement geometry or measurement voltage of the drilling-fluid sensor. However, measurement by the drilling-fluid sensor may be adversely affected when the size of granular solids in the drilling fluid being tested approached the size of the inter-electrode gap.

In the drilling-fluid sensor of an embodiment of the present invention, for any configuration of the electrodes in the drilling-fluid sensor, the inter-electrode capacitance C and conductance G are related to the relative permittivity $\in'$ and conductivity $\sigma'$ by the following:

$$C=k\in'\in_0 \tag{1}$$

and $$G=k\sigma' \tag{2}$$

where $\in_0$ is the permittivity of free space, approximately $8.854\times10^{-12}$ F $m^{-1}$, and k is a constant that depends on the geometrical configuration and disposition of the electrodes in the drilling-fluid sensor. Merely by way of example, for the situation where the drilling-fluid sensor comprises two or more plane-parallel electrodes of face area A and separation h, k may be defined as follows:

$$k=A/h \tag{3}$$

As noted above, in aspects of the present invention the number, shape and/or relative position of the electrodes may be changed in different embodiments of the present invention. In an aspect of the present invention, using the above relationships, the relative permittivity $\in'$ and the conductivity $\sigma'$ may be obtained from measurements of C and G, where, merely by way of example, C and G may be measured using an impedance analyzer, impedance meter and/or the like. As such, in an embodiment of the present invention, the drilling-fluid sensor may comprise an impedance measuring device and/or the like.

Merely by way of example, in FIG. 1, the measurements were made over a frequency range of about $20<f/Hz<2\times10^6$. However, measurements of C and G, may be made at different frequencies and/or over different frequency ranges in different aspects of the present invention.

FIG. 2 illustrates the effect on permittivity of a drilling fluid as a result of adding brine and fresh water to the drilling fluid, the permittivity being measured in accordance with an embodiment of the present invention. Merely by way of example, the illustrated data is measured for a frequency, f=300 Hz for a drilling fluid that comprises an OBM of specific gravity ("SG") of 1.38. The data plotted in FIG. 2 shows that the addition of fresh water and/or brine to the OBM causes an increase in the permittivity, such that measurements of the permittivity $\in'$ may enable, in accordance with an embodiment of the present invention, detection and measurement of an aqueous influx into the drilling fluid. This detection may, in certain aspects, be detected/measured at the surface or downhole while the drilling procedure is occurring.

FIG. 3 illustrates the effect on conductivity of a drilling fluid as a result of adding brine and fresh water to the drilling fluid, the conductivity being measured in accordance with an embodiment of the present invention. Merely by way of example, the illustrated data is measured for a frequency, f=300 Hz for a drilling fluid that comprises an OBM of specific gravity ("SG") of 1.38. The data plotted in FIG. 3 shows that the additions of both fresh water and brine to the OBM alter the conductivity $\sigma'$. Merely by way of example, FIG. 3 illustrates that the variation of $\sigma'$ is less sensitive to changes in the amount of water or and/or brine added to the OBM than the variation of $\in'$, as shown in FIG. 2. Accordingly, in one aspect of the present invention, permittivity $\in'$ may be measured for low frequencies to detect/measure the water and/or brine influx. Merely by way of example, a low frequency may be a frequency less than 1 kHz. However, in other aspects of the present invention, permittivity $\in'$ may be used to detect/measure influxes of water and/or brine into drilling fluid using frequencies greater than 1 kHz.

In accordance with one embodiment of the present invention, the systematic changes of $\in'$ and $\sigma'$ in relation to the amount of fresh water and/or brine mixed with the drilling fluid, as shown by measurements of capacitance C and conductance G, may be used to detect and/or measure aqueous influxes into the drilling fluid. In certain aspects, the influxes may be measured and/or detected while drilling.

Figure 4:
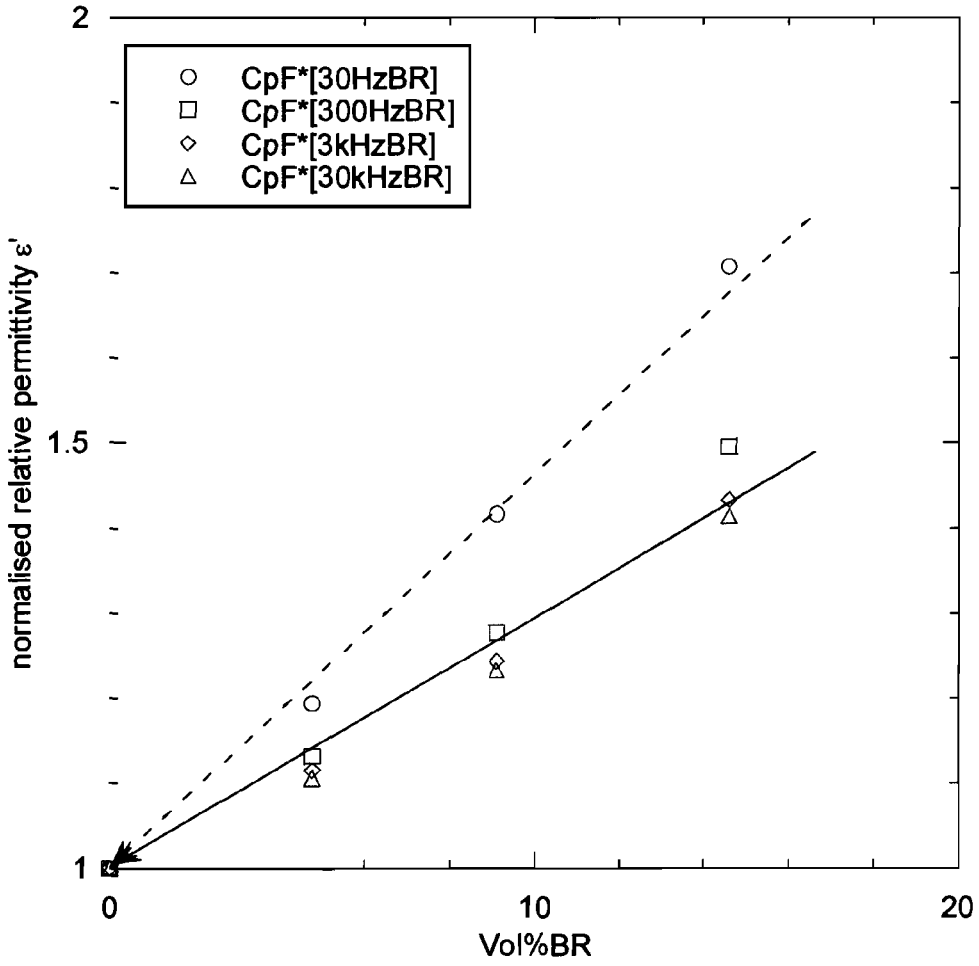
FIG. 4 is a graphical representation of permittivity versus the amount of brine added to an OBM where the permittivity $\in'$ or the capacitance C is normalized to unity when the volume fraction of the added brine is zero, the permittivity and/or the conductance being measured in accordance with an embodiment of the present invention.

FIG. 4 is a graphical representation of permittivity versus the amount of brine added to an OBM where the permittivity $\in'$ or the capacitance C is normalized to unity when the volume fraction of the brine is zero, the permittivity and/or the conductance being measured in accordance with an embodiment of the present invention. The OBM used for the depicted measurements had an SG of 1.6. In FIG. 4, for the vertical axis:

$$\in'(\nu)\div\in'(0)=C(\nu)\div C(0)$$

where $\nu$ is the volume fraction of the brine.

In FIG. 4, the horizontal axis shows the percentage by volume of added brine. FIG. 4 shows that normalized capacitance varies substantially linearly with ν for all frequencies. Merely by way of example, in FIG. 4 it can be seen that the measurement of the variation of normalized permittivity or capacitance in response to the influx of the brine is substantially frequency-independent for frequencies greater than 300 Hz.

Figure 5:
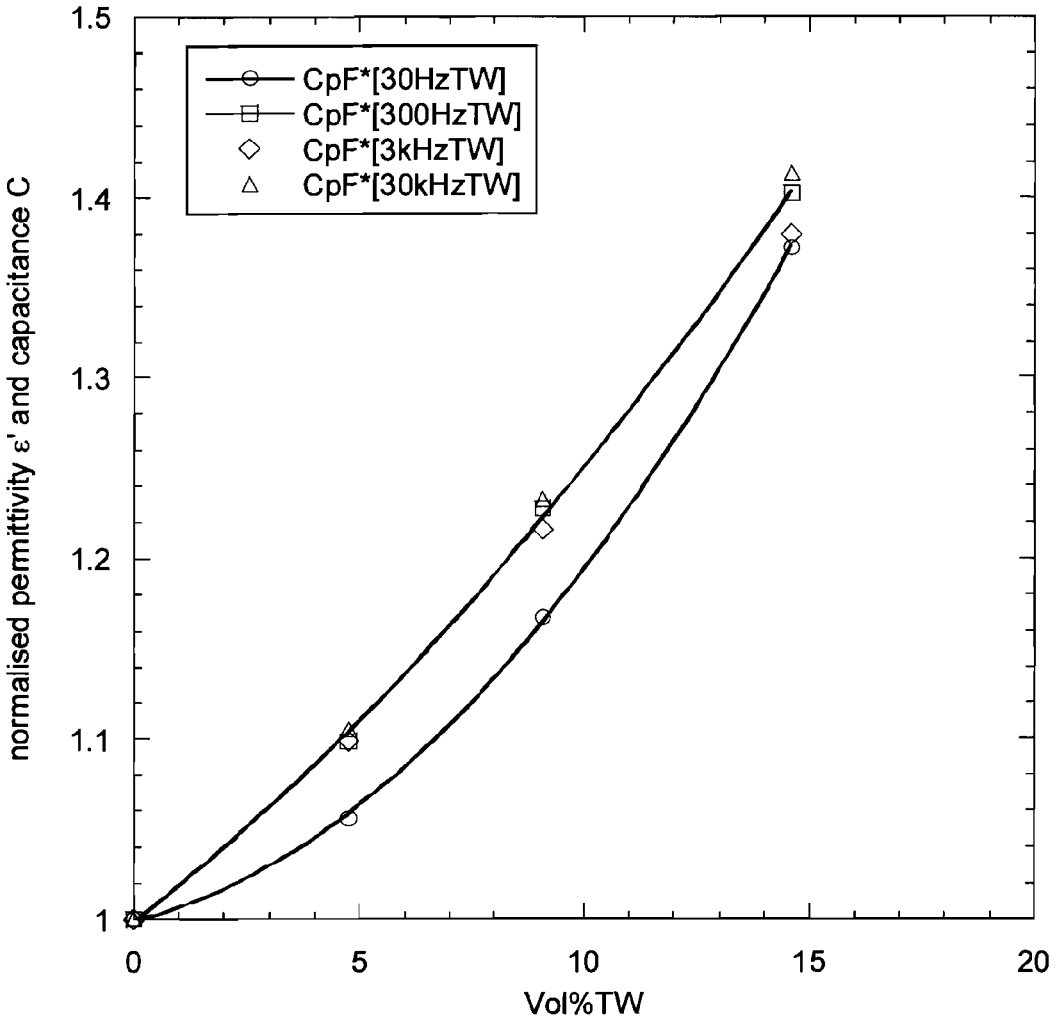
FIG. 5 is a graphical representation of permittivity versus the amount of fresh water added to an OBM where the permittivity $\in'$ or the capacitance C is normalized to unity when the volume fraction of the added fresh water is zero, the permittivity and/or the conductance being measured in accordance with an embodiment of the present invention.

FIG. 5 is a graphical representation of permittivity versus the amount of fresh water added to an OBM where the permittivity ∈' or the capacitance C is normalized to unity when the volume fraction of the fresh water is zero, the permittivity and/or the conductance being measured in accordance with an embodiment of the present invention.

Figure 6:
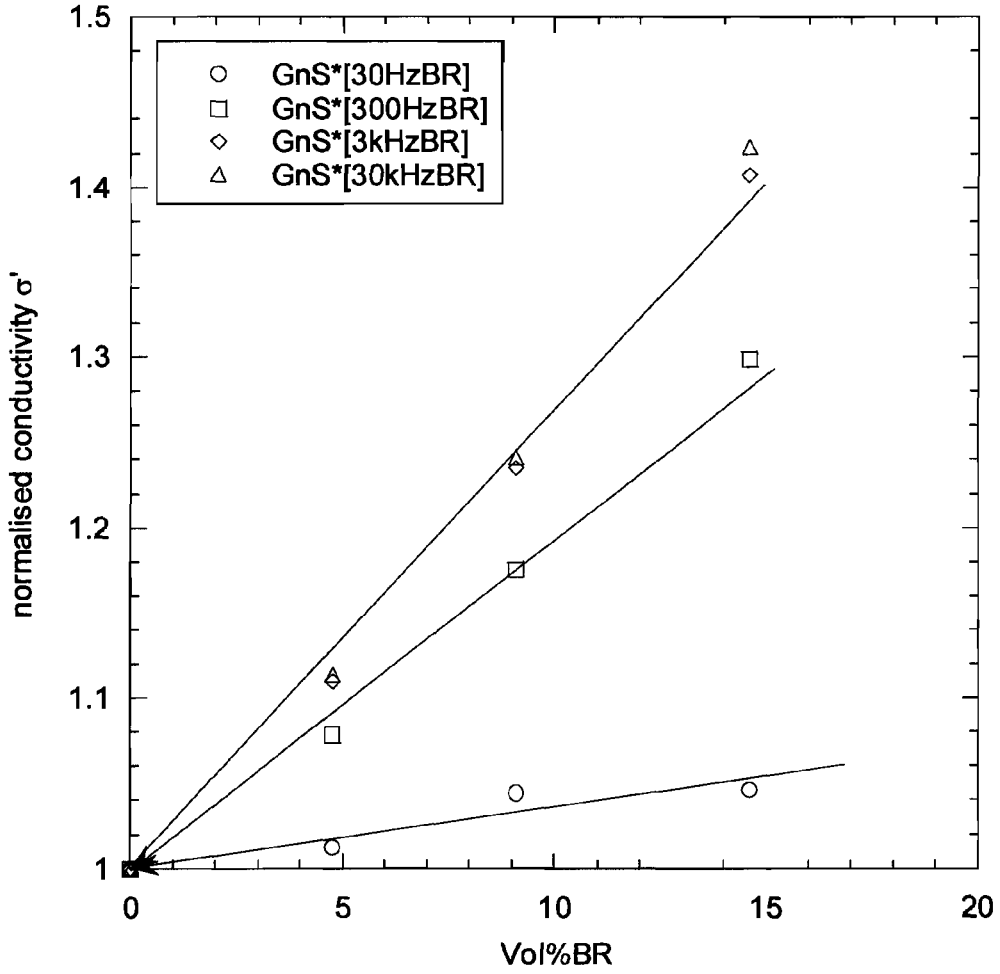
FIG. 6 is a graphical representation of conductivity versus amount of brine added to an OBM of SG equal to 1.6, in which the conductivity $\sigma'$ (or conductance G) is normalized to zero for a volume fraction ($\nu$) of added brine equal to zero, where measurements of the conductivity $\sigma'$ and/or the conductance G are made in accordance with an embodiment of the present invention.

FIG. 6 is a graphical representation of conductivity versus amount of brine added to an OBM of SG equal to 1.6, in which the conductivity σ' (or conductance G) is normalized to zero for a volume fraction (ν) of brine equal to zero, where measurements of the conductivity σ' and/or the conductance G are made in accordance with an embodiment of the present invention. In FIG. 6 on the vertical axis σ'(ν)÷σ'(0) is equal to G(ν)÷G(0).

In FIG. 6, the horizontal axis shows the percent by volume of added brine, i.e. 100ν. FIG. 6 illustrates that the normalized conductance varies substantially linearly with ν for all frequencies. By comparing FIG. 6 with FIG. 4 it can be seen that unlike capacitance, the measurement of variation of the conductance with brine influx is frequency-dependent.

Figure 7:
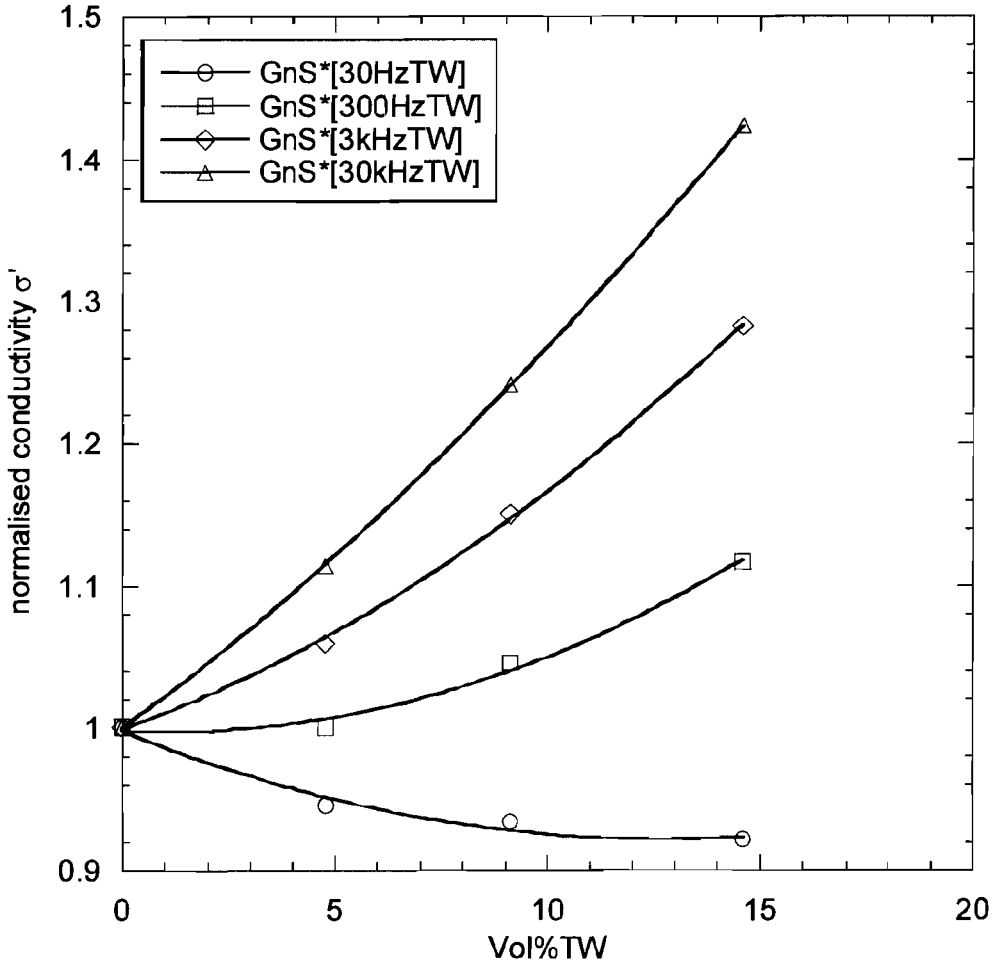
FIG. 7 is a graphical representation of conductivity versus amount of fresh water added to an OBM of SG equal to 1.6, in which the conductivity $\sigma'$ (or conductance G) is normalized to zero for a volume fraction ($\nu$) of fresh water equal to zero, where measurements of the conductivity $\sigma'$ and/or the conductance G are made in accordance with an embodiment of the present invention.

FIG. 7 is a graphical representation of conductivity versus amount of fresh water added to an OBM of SG equal to 1.6, in which the conductivity σ' (or conductance G) is normalized to zero for a volume fraction (ν) of fresh water equal to zero, where measurements of the conductivity σ' and/or the conductance G are made in accordance with an embodiment of the present invention. Whereas FIG. 6 shows that for all measurement frequencies adding brine to the OBM increases the normalized conductance, in FIG. 7 it is shown that the normalized conductance of the OBM at a measurement frequency of 300 Hz is decreased by the addition of fresh water to the OBM.

FIGS. 4-7 show that for measurements made in accordance with an embodiment of the present invention: (1) normalized capacitance varies substantially linearly with the volume fraction of fresh water or brine added to a drilling fluid for all measurement frequencies; and (2) measurement of normalized capacitance is almost frequency-independent for measurement frequencies above about 300 Hz.

For OBMs it can be shown that:

$$C/C(0)=\in'/\in'(0)=1+K_C\nu \quad (4)$$

where $K_C$ is an parameter that describes the effect of the aliquots on the capacitance (i.e. the permittivity); and ν is the volume fraction of added brine or fresh water, e.g. ν=0.05 for a 5 volume-percent aliquot. As such, the total aqueous phase volume fraction is greater than ν owing to the OBM's connate brine. In equation (4), $K_C$ is always positive, i.e. C (and the permittivity ∈') increase with the brine or water added to the OBM. Using equation (4), it has been determined that over all aliquots, the mean value of $\overline{K}_C$ is 3.4±0.8 and that $\overline{K}_C^{brine}$ and $\overline{K}_C^{water}$ are the same within experimental uncertainty.

FIGS. 4-7 show that the normalized conductance may vary linearly or non-linearly with the volume fraction of fresh water or brine ν, with a different frequency-dependence according to whether fresh water or brine was added. Thus, from the above and in accordance with certain embodiments of the present invention, it is found that: (a) the normalized capacitance for measurement frequencies greater than 300 Hz is a reliable way to detect and/or measure aqueous volume fraction influx into a drilling fluid, where the detection measurement is independent of the salinity of the influx; (b) for a given measurement frequency, the normalized conductance depends systematically on the aqueous volume fraction influx as well as the salinity of the influx; and (c) information on the volume of the influx and the salinity of the influx can be obtained by measuring both the normalized capacitance and the normalized conductance.

Figure 8:
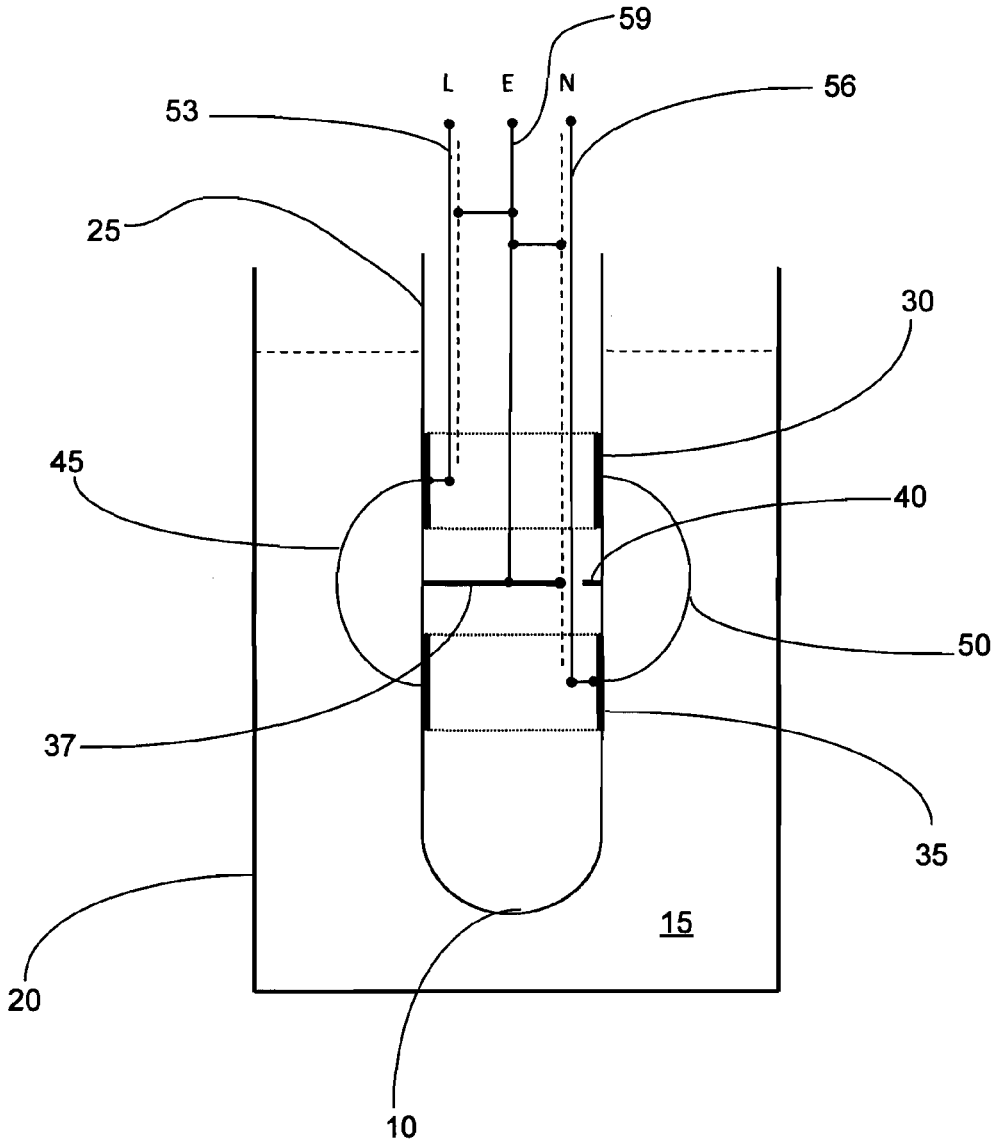
FIG. 8 is a schematic-type illustration of a dielectric probe for measuring or detecting influx of water or brine into a drilling fluid, in accordance with one embodiment of the present invention.

FIG. 8 is a schematic-type illustration of a dielectric probe for measuring or detecting influx of water or brine into a drilling fluid, in accordance with one embodiment of the present invention. In an aspect of the present invention, a drilling-fluid sensor 10 may be contacted with and/or disposed in a drilling fluid 15. In one embodiment of the present invention, the drilling fluid 15 may comprise an OBM. In the depicted aspect, the drilling fluid 15 is disposed within a sampling container 20. The sampling container 20 may be a receptacle, sampling device and/or the like for receiving the drilling fluid 15 from a borehole (not shown) being drilled by a drilling process using the drilling fluid 15. In different aspects of the present invention, the sampling container 20 may be in or adjacent to the borehole or may be located at the surface or in a testing facility.

In one embodiment of the present invention, the sampling container 20 may comprise an electrically conducting material. In certain aspects of the present invention, because the drilling fluid may comprise a weak conductivity, the sampling container 20 may comprise a conductive polymer, conductive ceramic and/or the like. In other aspects, the sampling container 20 may comprise higher conductivity materials, such as metals or the like.

In one embodiment, the drilling-fluid sensor 10 may comprise an outer-insulating body 25 that may be coupled with at least a first electrode 30 and a second electrode 35. The first and the second electrodes 30, 35 may in some aspects comprise flat, curved or ring shaped electrodes. In certain aspects of the present invention, the first and second electrodes 30, 35 may comprise ring electrodes and may be configured to be made flush with the outer-insulating body 25 to enable the drilling-fluid sensor 10 to be easily cleaned. In one embodiment of the present invention, a shield-plate 40 may be positioned between the first and the second electrodes 30, 35 and may provide an electrical shield between the first electrode 30 and the second electrode 35.

The drilling-fluid sensor 10 may be used to measure the capacitance and/or the conductance between the first electrode 30 and the second electrode 35 through the drilling fluid 15, e.g. via lines of field 45 and 50. Using the shield-plate 40 may provide that capacitance and/or the conductance between the first electrode 30 and the second electrode 35 is measured substantially through the lines of field 45 and 50 and not through stray field lines and/or materials other than the drilling fluid 15.

In some aspects of the present invention, a first conductor 53 and a second conductor 56 may be used to connect the first and second electrodes 30 and 35, respectively, to an impedance meter (not shown). In one embodiment a third conductor 59 may be used to connect the shield plate 37 to the impedance meter. In such an embodiment, merely by way of example, the conductors 53, 56 and 59 may be used to connect the first and second electrodes 30 and 35 and the shield plate 37 and 12 to the live (L), neutral (N), and earth or ground (E) terminals of a three-terminal impedance meter set up to measure appropriate ranges of capacitance and conductance. In an aspect of the present invention, the sampling container 20 may also be connected to ground so as to restrict the field lines between the first and the second electrode 30, 35 to the drilling fluid 15. In some aspects of the present invention, the conductors 53, 56 and 59 may be shielded, for example by use of coaxial lines or the like, and/or the outer conductor may be grounded.

The drilling-fluid sensor 10 may be used to measure capacitance and/or conductance of the drilling fluid 15 from which measurements the influx/amount of water and/or brine in the drilling fluid 15 may be detected and/or measured. In an aspect of the present invention, the appropriate value for the constant k—as provided in equations (1), (2) and/or (3)—may be found from calibration, for example, by measuring the capacitance of the drilling-fluid sensor 10 in a fluid of known relative permittivity, such as air, kerosene and/or the like.

Figure 9:
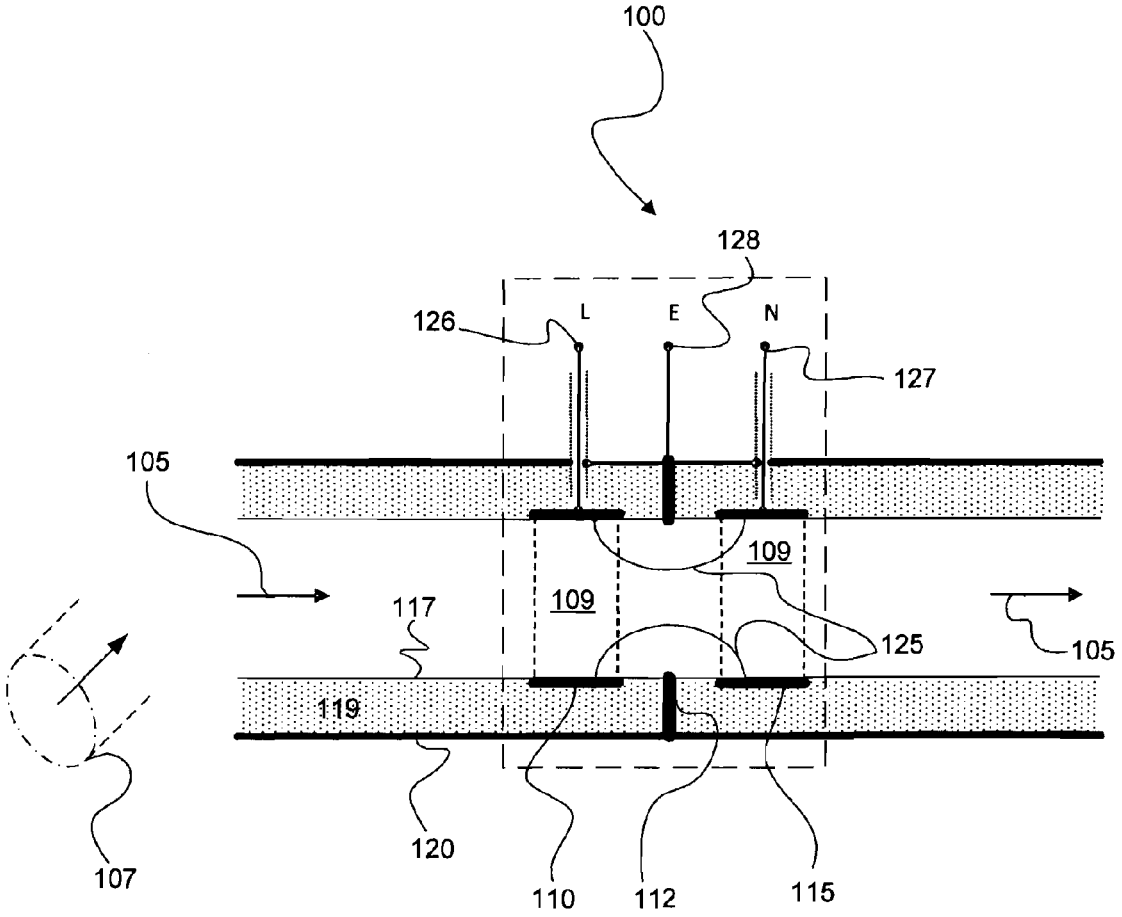
FIG. 9 is a schematic depiction of a drilling-fluid sensor for automatic detection/measurement of water of brine influx into a drilling fluid, in accordance with an embodiment of the present invention.

FIG. 9 is a schematic depiction of a drilling-fluid sensor for detection/measurement of water of brine influx into a drilling fluid, in accordance with an embodiment of the present invention. In an embodiment of the present invention, a drilling-fluid sensor 100 may be installed on a drilling rig (not shown) to monitor and detect influx of water and/or brine into a drilling fluid 105. The drilling-fluid sensor 100 may be coupled with a wellbore being drilled, drill pipe or casing in the borehole being drilled, diversion pipes coupled with the borehole being drilled, surface installations/pipes coupled with the borehole being drilled and/or the like.

In one embodiment of the present invention, the drilling-fluid sensor 100 may comprise at least a first electrode 110 and a second electrode 115. In an aspect of the present invention, at least one of the first electrode 110 and the second electrode 115 may be positioned so as to be flush with an inner wall 117 of an insulating-sensor-body 119 through which the drilling fluid 105 flows. Such an arrangement may, among other things, provide for the avoidance of build-up of mud, solids or the like on the first and second electrodes 110, 115.

In an embodiment of the present invention, the insulating sensor body 119 may be a section of a pipe (not shown) or coupled with, incorporated with a pipe (not shown) through which the drilling fluid 105 is flowing. In some aspects, the drilling-fluid sensor 100 may comprise an intake conduit 107 that may be configured to collect/direct the drilling fluid flowing in the drilling procedure into a sensing location 109 within the drilling-fluid sensor 100. In some aspects, the flow of the drilling procedure during the drilling procedure may be used to generate a flow of the drilling fluid through the intake conduit 107 and into the sensing location 109. In other aspects, a pump or the like may be used to generate a flow of the drilling fluid through the intake conduit 107 and into the sensing location 109.

In an aspect of the present invention, the first and second electrodes 110, 115 may comprise a conductive material that repels solid particles in the drilling fluid so as to prevent accretion of the particles leading to blocking. Merely by way of example, the first and second electrodes 110, 115 may comprise carbon-filled low-friction polymers such as Teflon or the like.

In an embodiment of the present invention, the drilling fluid 105 may flow as part of the drilling process or may be caused to flow. In some aspects of the present invention, insulating sensor body 119 is configured to be electrically insulating and/or the insulating sensor body 119 is hollow. In an embodiment of the present invention, an outer-wall 120 of the insulating sensor body 119 comprises a conductive material. In one embodiment of the present invention, a shield plate 112 may be disposed between the first and second electrodes 110, 115. The shield plate 112 may comprise a conductive material. In one embodiment of the present invention, the outer-wall 120 and/or the shield plate 112 may act to prevent electric field lines from connecting the first and second electrodes 110, 115 inside/through the insulating sensor body 119. Lines of electric field 125 may connect the first and second electrodes 110, 115 via the drilling fluid 105 to be measured.

In one embodiment of the present invention, the first and second electrodes 110, 115 may comprise ring-electrodes disposed around the inner-wall 117 of the insulating sensor body 119. Conductors 126, 127, and 128 may connect the first and second electrodes 110, 115 and/or the shield plate 112 to an impedance measurement device and/or the like (not shown). In an aspect of the present invention, the conductors 126, 127, and 128 may connect the first and second electrodes 110, 115 and the shield plate 112 to the live (L), neutral (N), and earth or ground (E) terminals of a three-terminal impedance meter set up to measure appropriate ranges of capacitance and conductance.

The first and second electrodes 110, 115 may be shielded, for example, by use of coaxial lines and/or the outer conductor of the conductors 126, 127, and 128 may be grounded. In certain embodiments of the present invention, the drilling-fluid sensor 100 will have a negligible stray capacitance or conductance, and the relationships of equations (1) and (2) may be used to process the measurements from the impedance meter or the like. An appropriate value for the constant k in Eq. (3) may be found from calibration, for example, by measuring the capacitance of the drilling-fluid sensor 100 in a fluid such as air or kerosene of known relative permittivity.

In some embodiments of the present invention, drilling-fluid sensor 100 may be positioned at a downhole location, close to the drill-bit and/or the like and dielectric information or the like obtained by the drilling-fluid sensor 10 may be transmitted by telemetry to the surface. Merely by way of example, the telemetry may comprise acoustic telemetry, wired drillpipe and/or the like.

In some embodiments of the present invention, the data obtained from the drilling-fluid sensor 100 may be used inform a driller controlling the drilling procedure of an interaction with an aquifer as the borehole is being drilled allowing for changes in the drilling process, such as a change in drilling trajectory, a change in drilling characteristics (such as drilling rotation, drilling speed, application/generation of side forces etc.) and/or the like. In some embodiments of the present invention, the data obtained from the drilling-fluid sensor 100 may be used alert a drilling fluid engineer that drilling fluid parameters are likely to change owing to the aqueous influx, and hence allow for appropriate action, for example, to add more surfactants to the drilling fluid, alter the drilling fluid composition and/or the like to be decided.

Figure 10:
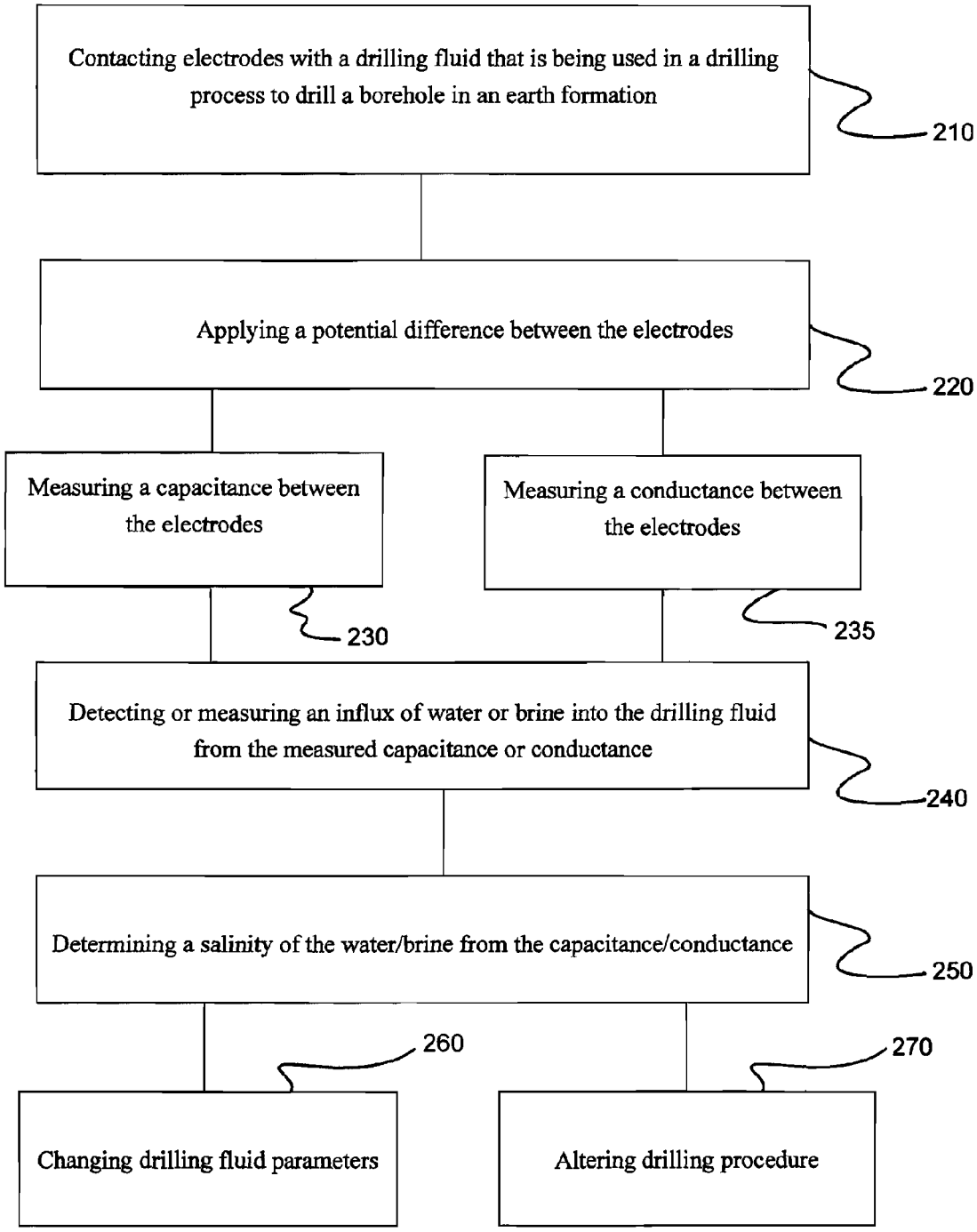
FIG. 10 is a flow-type illustration of a method for detecting and/or measuring an influx of water and/or brine into a drilling fluid being used in a drilling process, in accordance with an embodiment of the present invention.

FIG. 10 is a flow-type illustration of a method for detecting and/or measuring an influx of water and/or brine into a drilling fluid being used in a drilling process, in accordance with an embodiment of the present invention. In step 210 of the depicted method, electrodes are contacted with a drilling fluid being used in a drilling procedure to create a borehole in an earth formation. In different aspect of the present invention, two or more electrodes may be contacted with the drilling fluid. Merely by way of example, the drilling fluid may comprise an oil based mud.

In step 210, the drilling fluid may be sampled from the borehole by a sampling system or the electrodes may be contacted with the drilling fluid in situ. Merely by way of example, in some embodiments of the present invention a wellbore tool comprising the electrodes may be deployed in the wellbore. In other aspects, samples of the drilling fluid may be removed from the wellbore or as the drilling fluids are circulated outside of the wellbore. In some embodiments, the electrodes may be disposed downhole. In such embodiments of the present invention, the sensor/electrodes may be coupled with drill pipe used in the wellbore, with casing used in the wellbore and/or with a pipe capable of carrying a portion of the drilling fluid during a drilling operation such that the sensor/electrodes may be used to measure water/salinity influx during a drilling procedure.

In step 220, a potential difference may be applied across the electrodes. The potential difference may be generated by a electrical power source coupled with the electrodes. In step 230, the capacitance between the electrodes may be measured. Merely by way of example, the capacitance may be measured with an impedance meter, a multimeter, a voltmeter and/or the like. In some embodiments of the present invention, the capacitance measurement may be normalized, where normalization may be performed: using prior data from the particular electrode, power source and detector arrangement, i.e., by prior use of the system with a fluid with known properties; using prior data from an equivalent system; using modeling, using empirical data; by experimentation; and/or the like.

In step 235, the electrodes may be used to measure a conductance of the drilling fluid. Merely by way of example an impedance meter, impedance analyzer, oscilloscope, voltmeter, multi-meter and/or the like may be coupled with the electrodes and used to measure/determine the conductance.

In step 240, an influx of water and/or brine into the drilling fluid may be detected and/or measured using the measured capacitance and/or conductance. In certain aspects, a processor, software and/or the like may be used to process the capacitance measurement(s) to provide for the detection/measurement of the influx of the water and/or the brine. As discussed in more detail above, in an embodiment of the present invention, measured capacitance may be a salinity independent way of processing water/brine influx. In other aspects of the present invention, the measured conductance may be processed to detect and/or measure the influx of water and/or brine into the drilling fluid. As noted above, conductance changes caused by influxes of water/brine may be smaller than changes in capacitance.

In step 250, the measured capacitance/conductance may be used to determine a salinity of the influx. Conductivity of the drilling fluid varies depending on the amount and the salinity of the influx. As such, the conductance will vary according to the salinity of the influx and the salinity may therefore be processed from the conductance measurement, the conductance and the capacitance measurement and/or the like.

In step 260, detection/measurement of an influx of water/brine may be communicated to a drilling fluid engineer, a processor controlling/monitoring the drilling fluid, a display system, an automated control system and/or the like to provide for changing the properties the drilling fluid to account for the influx. Merely by way of example, the quantities of additives, such as surfactants or the like, may be changed to address the effect of the influx on the drilling fluid. In some aspects of the present invention, effect of the influx may be taken into account in standard drilling fluid tests, such as the API Emulsion Stability Test or the like, so that the standard test does not provide a misleading result due to the influx. In further aspects, because the influx of ware/brine may have adverse effects on the drilling mud, which may also adversely affect the drilling process and because it may not be possible to easily correct the adverse effects of the water/brine influx, the trajectory of the borehole being drilled may be altered when an influx is detected to limit the amount of water/brine entering the borehole, i.e., to avoid the aquifer or the like containing the water/brine.

In step 270, detection/measurement of an influx of water/brine may be communicated to a driller, a processor controlling/monitoring the drilling process, a display system and/or the like to provide for changing the drilling procedure. Changes may include altering the drilling trajectory to avoid an aquifer associated with the influx, changing drilling parameters to adapt for the influx and/or the like. Communication of data concerning the detection or measurement of the influx of formation water or brine may in some aspects be transmitted from a downhole location where the detection/measurement is made to a surface location where the drilling operation may be controlled. Transmission may be via wired drill pipe, wired casing, a telemetry system and/or the like. In some aspects, data concerning the detection/measurement of the influx may be communicated to a downhole processor.

Figure 11:
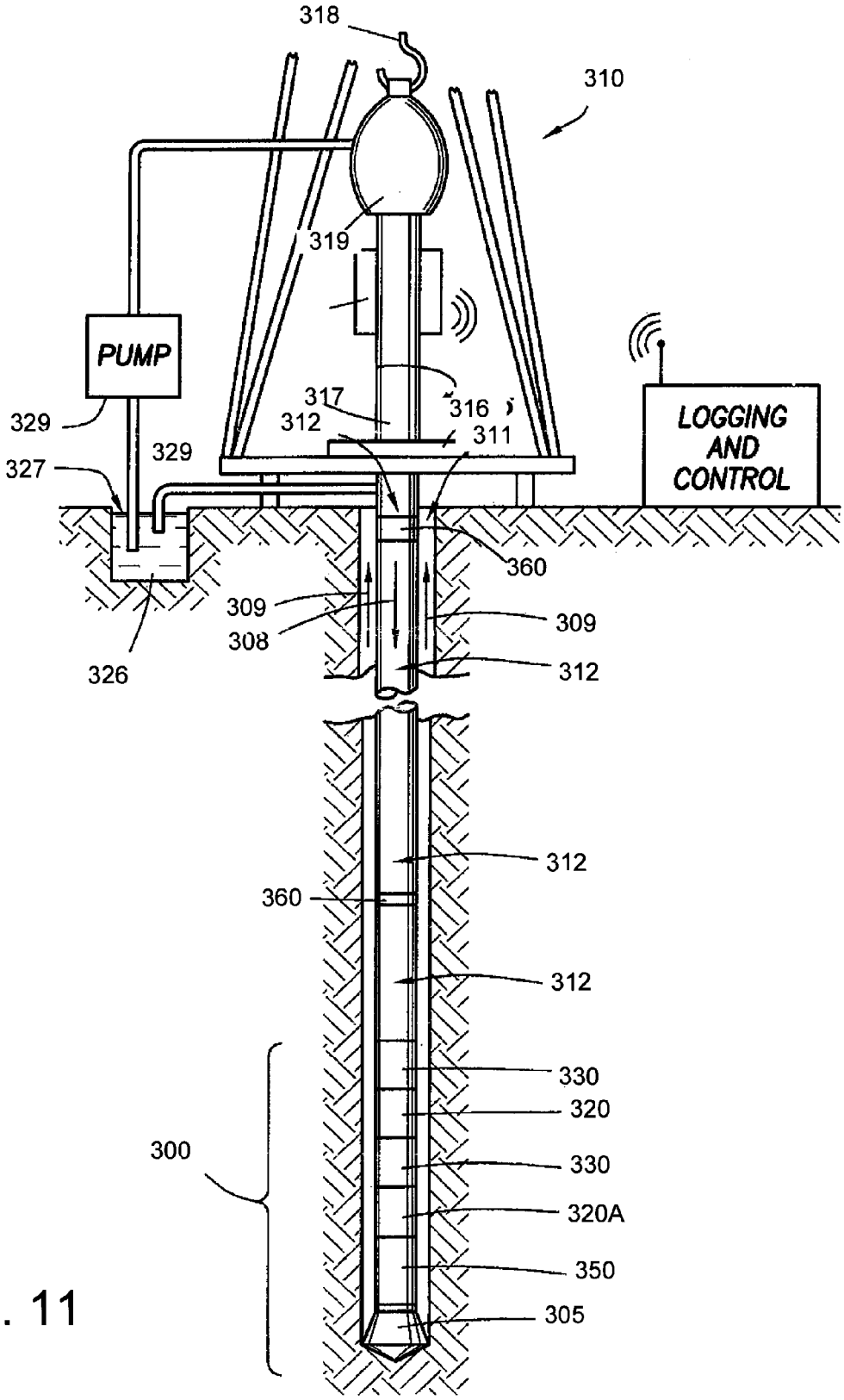
FIG. 11 is a schematic illustration of a drilling assembly comprising a drilling-fluid sensor, in accordance with an embodiment of the present invention.

FIG. 11 illustrates a wellsite system including a drilling-fluid sensor, in accordance with an embodiment of the present invention. The wellsite can be located onshore or offshore. In this exemplary system, a borehole 311 is formed in subsurface formations by rotary drilling in a manner that is well known. Embodiments of the invention can also use be used in directional drilling systems, pilot hole drilling systems, cased drilling systems, coiled tubing drilling systems and/or the like.

A drill string 312 is suspended within the borehole 311 and has a bottom hole assembly 300 which includes a drill bit 305 at its lower end. The surface system includes a platform and derrick assembly 310 positioned over the borehole 311, the assembly 310 including a rotary table 316, kelly 317, hook 318 and rotary swivel 319. The drill string 312 is rotated by the rotary table 316, energized by means not shown, which engages the kelly 317 at the upper end of the drill string. The drill string 312 is suspended from a hook 318, attached to a traveling block (also not shown), through the kelly 317 and the rotary swivel 319 which permits rotation of the drill string relative to the hook. As is well known, a top drive system could alternatively be used.

In the example of this embodiment, the surface system further includes drilling fluid or mud 326 stored in a pit 327 formed at the well site. A pump 329 delivers the drilling fluid 326 to the interior of the drill string 312 via a port in the swivel 319, causing the drilling fluid to flow downwardly through the drill string 312 as indicated by the directional arrow 308. The drilling fluid exits the drill string 312 via ports in the drill bit 305, and then circulates upwardly through the annulus region between the outside of the drill string and the wall of the borehole, as indicated by the directional arrows 309. In this well known manner, the drilling fluid lubricates the drill bit 305 and carries formation cuttings up to the surface as it is returned to the pit 327 for recirculation.

The bottom hole assembly 300 of the illustrated embodiment may include a logging-while-drilling (LWD) module 320, a measuring-while-drilling (MWD) module 330, a roto-steerable system and motor, and drill bit 305.

The LWD module 320 may housed in a special type of drill collar, as is known in the art, and can contain one or a plurality of known types of logging tools. It will also be understood that more than one LWD and/or MWD module can be employed, e.g. as represented at 320A. The LWD module may include capabilities for measuring, processing, and storing information, as well as for communicating with the surface equipment. In one embodiment, the LWD module may include a fluid sampling device.

The MWD module 330 may also housed in a special type of drill collar, as is known in the art, and can contain one or more devices for measuring characteristics of the drill string and drill bit. The MWD tool may further includes an apparatus (not shown) for generating electrical power to the downhole system. This may typically include a mud turbine generator powered by the flow of the drilling fluid, it being understood that other power and/or battery systems may be employed. In one embodiment, the MWD module may includes one or more of the following types of measuring devices: a weight-on-bit measuring device, a torque measuring device, a vibration measuring device, a shock measuring device, a stick slip measuring device, a direction measuring device, and an inclination measuring device.

In an embodiment of the present invention, a drilling-fluid sensor 360, as described in more detail herein, comprising electrodes for contacting the drilling fluid may be coupled with the drillstring 312, a casing (not shown) of the borehole 311, the bottomhole assembly 300, the pit 327, a pipe for carrying the drilling fluid 329 and/or the like. By positioning the drilling-fluid sensor 360 downhole, i.e., by coupling the drilling fluid sensor 312 with the drillstring 312, the casing, the bottomhole assembly 300 and/or the like, an influx of water/brine into the drilling fluid 326 may be detected in real-time. This detection of an influx of water/brine into the drilling fluid 326 may be transmitted to the surface by telemetry means, such as via wired drill pipe, mud pulse telemetry, optic telemetry, acoustic telemetry, wireless communication and/or the like. In some aspects, a processor may be positioned downhole and may be used for communication purposes, controlling the drilling operation and/or the like.

While the principles of the disclosure have been described above in connection with specific apparatuses and methods, it is to be clearly understood that this description is made only by way of example and not as limitation on the scope of the invention.

What is claimed is:

1. A method for detecting and monitoring formation water or brine influx into an oil-based drilling fluid for use in a drilling procedure for drilling a borehole in an earth formation, comprising:

contacting a first and a second electrode with the oil-based drilling fluid;

applying a potential difference between the first and the second electrode;

measuring a capacitance between the first and the second electrode;

measuring a conductance between the first and the second electrode, wherein the capacitance and the conductance are measured using a measurement voltage of between 0.1 and 10 volts; and processing a volume of formation water or brine in the oil-based drilling fluid and a salinity of the influx from the measured capacitance and conductance.

2. The method according to claim 1, wherein the step of contacting a first and a second electrode with the drilling fluid is performed while the drilling procedure is occurring.

3. The method according to claim 1, wherein the step of contacting the first and the second electrode with the drilling fluid is performed downhole.

4. The method according to claim 1, wherein the capacitance is measured using a measurement frequency between 300 Hz and 1 KHz.

5. The method according to claim 1, wherein the capacitance is normalized.

6. The method according to claim 1, further comprising:

correcting an emulsion stability measurement made on the oil based drilling fluid to account for the volume of the influx.

7. The method according to claim 3, further comprising:

transmitting data concerning the detection or measurement of the formation water or brine from a downhole location to a surface location.

8. The method according to claim 1, further comprising:

altering properties of the drilling procedure in response to the measurement of the volume of the influx of formation water or brine.

9. The method according to claim 8, wherein the step of altering properties of the drilling process comprises altering a drilling trajectory.

10. The method according to claim 1, further comprising:

changing the composition of the drilling fluid in response to the measured volume of the influx of formation water or brine.

11. The method according to claim 10, wherein the step of changing the composition of the drilling fluid comprises changing an amount of surfactants in the drilling fluid.

12. The method according to claim 1, wherein the volume of the influx comprises a volume fraction of the influx in the oil based drilling fluid.

13. A system for measuring a volume of formation water or brine influxes during a drilling procedure to drill a borehole through an earth formation, comprising:

a drilling-fluid sensor configured for contacting with a drilling fluid used in the drilling procedure, the drilling-fluid sensor comprising:

a first electrode;

a second electrode, wherein the first and the second electrode are configured for contacting an oil based drilling fluid in the borehole;

a power source for applying a potential difference between the first and the second electrode, wherein the power source applies a measurement voltage between 0.1 and 10 volts;

an impedance meter for measuring a capacitance and a conductivity between the first and the second electrode; and a processor configured to process from the measured capacitance and conductivity a volume fraction of formation water and/or brine in the drilling fluid and a salinity of the formation water and/or brine in the drilling fluid.

14. The system according to claim 13, wherein the first and the second electrodes comprise ring electrodes.

15. The system according to claim 13, wherein the first and the second electrodes are flush mounted onto an inner-wall of a pipe.

16. The system according to claim 15, wherein the pipe comprises an electrically insulating body.

17. The system according to claim 16, wherein the electrically insulating body is hollow.

18. The system according to claim 15, wherein the pipe comprises drillpipe.

19. The system according to claim 13, wherein the power source applies a measurement frequency between 300 and 1000 Hertz.

20. The system according to claim 13, further comprising:

a shield plate positioned between the first and the second electrode and configured to shield the first electrode from the second electrode to provide that in use capacitance between the first electrode and the second electrode is established through the drilling fluid.

21. The system according to claim 13, further comprising:

a display for displaying an output from the processor.

22. The system according to claim 13, further comprising an intake conduit configured in use to direct the drilling fluid into contact with the first and the second electrodes.

* * * * *